US007083690B2

(12) United States Patent
Dobbins et al.

(10) Patent No.: US 7,083,690 B2
(45) Date of Patent: Aug. 1, 2006

(54) CATALYST SYSTEM FOR RENDERING ORGANIC PROPELLANTS HYPERGOLIC WITH HYDROGEN PEROXIDE

(75) Inventors: Thomas A. Dobbins, Howard, OH (US); David B. Wiley, Warsaw, OH (US)

(73) Assignee: Wiley Organics, Inc., Coshocton, OH (US)

( * ) Notice: Subject to any disclaimer, the term of this patent is extended or adjusted under 35 U.S.C. 154(b) by 43 days.

(21) Appl. No.: 10/180,210

(22) Filed: Jun. 26, 2002

(65) Prior Publication Data

US 2003/0015268 A1 Jan. 23, 2003

Related U.S. Application Data

(60) Provisional application No. 60/344,715, filed on Oct. 24, 2001, and provisional application No. 60/302,729, filed on Jul. 3, 2001.

(51) Int. Cl.
*D03D 23/00* (2006.01)

(52) U.S. Cl. ..... 149/109.6

(58) Field of Classification Search ..... 149/1, 149/108.6, 109.6; 60/211, 212
See application file for complete search history.

(56) References Cited

U.S. PATENT DOCUMENTS

| | | | | |
|---|---|---|---|---|
| 2,285,878 | A | 6/1942 | White et al. | |
| 2,693,077 | A | 11/1954 | Malina et al. | |
| 2,819,233 | A | 1/1958 | Smith | |
| 4,180,386 | A * | 12/1979 | McCormack et al. | 44/351 |
| 4,189,306 | A * | 2/1980 | Sandy | 44/362 |
| 5,076,813 | A | 12/1991 | Alberici et al. | |
| 5,433,802 | A | 7/1995 | Rothgery et al. | |
| 5,616,882 | A | 4/1997 | Nichols et al. | |
| 5,932,837 | A | 8/1999 | Rusek et al. | |
| 6,073,437 | A | 6/2000 | Jones | |
| 6,254,705 | B1 | 7/2001 | Anflo et al. | |
| 6,272,846 | B1 | 8/2001 | Schneider | |
| 6,419,771 | B1 | 7/2002 | Lormand | |

FOREIGN PATENT DOCUMENTS

WO WO 99/32420 7/1999

OTHER PUBLICATIONS

Hulbert, E. et al., "Nontoxic Orbital Maneuvering and Reaction Control Systems for Reusable Spacecraft", *Journal of Propulsion and Power*, vol. 14, No. 5, pp. 676–687 (Sep.–Oct. 1998).

Walls, T. et al., "Performance and Safety Aspects of Monopropellant and Non–Toxic Bipropellant Liquid Divert/ACS Propulsion for Navy TBMD Applications", presented at the 2nd Annual AIAA SDIO Interceptor Technology Conference, Albuquerque, New Mexico (Jun. 1993).

Abstract from Database WPI Sectin Ch, Week 197444, Derwent Publications ltd., London, GB; Class E12, AN 1974–76543V, XP–002233202 and JP 49 066637 A (Dainippon Ink & Chem KK) Jun. 1974.

* cited by examiner

*Primary Examiner*—Aileen Felton
(74) *Attorney, Agent, or Firm*—Thompson Hine LLP

(57) ABSTRACT

Novel catalysts capable of rendering both polar and non-polar organic fuels hypergolic with rocket-grade hydrogen peroxide are disclosed. These catalysts are complexes formed by reacting alkyl-substituted diamines or triamines, with metal salts of an aliphatic carboxylic acid or metal 1,3 dione chelates. In addition, the use of various acetylenic compounds as stability enhancing additives and/or promoters is described.

14 Claims, No Drawings

CATALYST SYSTEM FOR RENDERING ORGANIC PROPELLANTS HYPERGOLIC WITH HYDROGEN PEROXIDE

CROSS-REFERENCE TO RELATED APPLICATIONS

This application claims priority from U.S. Provisional Application No. 60/344,715 filed Oct. 24, 2001, and U.S. Provisional Application No. 60/302,729 filed Jul. 3, 2001, the disclosures of which are hereby incorporated by reference.

BACKGROUND OF THE INVENTION

The present invention relates to the use of the complexes formed by metallic salts of aliphatic carboxylic acids or metallic chelate 1,3-dione compounds with alkyl-substituted diamines or alkyl-substituted triamines as catalysts to impart hypergolicity (i.e. self-ignition) to a wide variety of both polar (i.e. alcohols) and non-polar (i.e. octane, decane, kerosene) organic fuels when rocket-grade hydrogen peroxide is employed as an oxidizer. The alkyl substituted diamines and alkyl-substituted triamines are integral constituents of the catalyst at the molecular level. If the amines are employed in stoichiometric excess, however, they can additionally serve as either promoters or co-solvents (phase-joiners).

U.S. Pat. No. 5,932,837 to Rusek discloses catalyst systems suitable for use with polar organic fuels that are miscible with hydrogen peroxide such as low molecular weight alcohols or ketones. The catalyst system consists of an amine or amide to function as a "propagator" (i.e. as a promoter) and a metal salt such as a metal acetate that decomposes in solution to form a metallic oxide with the desired catalytic activity capable of rendering the fuel hypergolic with rocket-grade hydrogen peroxide. Rusek teaches the use of amines selected from the group comprising urea, formamide, acetamide, ethylenediaminetetraacetic acid ('EDTA') or base-substituted EDTA. The catalyst systems described by Rusek form "microdispersed colloidal" metallic oxides in situ. However, these insoluble particles have the undesirable property of coagulating or precipitating over time. Moreover, they cannot be prepared in non-polar organic fuels in which the precursor metal salt is insoluble.

Eric Hurlbert et al. in "Nontoxic Orbital Maneuvering and Reaction Control Systems for Reusable Spacecraft" Journal of Propulsion and Power, Vol. 14, No. 5 (1998) have previously described the use of unspecified amounts of tetramethylethylenediamine ("TMEDA") as a "promoter" in conjunction with catalysts consisting of the dodecyl benzenesulfonic acid and other aromatic hydrocarbon sulfonic acid salts of cobalt, chromium, copper, and iron to catalyze the decomposition of hydrogen peroxide, therby imparting hypergolicity to kerosene and other non-polar organic fuels. Cobalt, chromium, copper, and iron salts of dodecyl benzenesulfonic acid and mixed dodecyl benzenesulfonic acid salts of these metals and other "long carbon chain" aromatic acids were selected by the authors of this paper because they are appreciably soluble in kerosene and other non-polar hydrocarbon fuels, i.e. "fuel-soluble."

The authors of the aforementioned paper allege: "The catalyst, the promoter, and the complex formed by them must all be soluble in kerosene to make the fuel homogenous." However, both the metallic salts of the aliphatic carboxylic acids and the metallic aliphatic carboxylate-amine complexes of the present invention are insoluble or only very sparingly soluble in kerosene and other non-polar organic compounds, yet they are capable of forming homogeneous mixtures in kerosene and other non-polar organic compounds (i.e. octane, decane, etc . . . ) if TMEDA or other amines, alcohols, acetylenic compounds, or other polar organic compounds are employed as co-solvents or phase-joiners.

A variety of organometallic compounds that are soluble in hydrocarbons (i.e. methylcyclopentadienylmanganese tricarbonyl, manganese (II) 2-ethylhexanoate, and dicylopentadienyl iron or "ferrocene") were evaluated by the authors of the present invention in conjunction with TMEDA and other amines for their ability to catalyze the decomposition of hydrogen peroxide and to render both polar and non-polar liquid organic fuels hypergolic. The fact that these combinations did not prove to be effective demonstrates that the solubility of the metallic species in hydrocarbons is not a critical factor.

BRIEF SUMMARY OF THE INVENTION

The present invention relates in general to the use of various novel catalysts to promote the decomposition of hydrogen peroxide and to impart hypergolicity (i.e. render self-igniting with hydrogen peroxide) to polar as well as non-polar organic fuels. The catalysts useful in accordance with the present invention include complexes formed by amines and metal salts of aliphatic carboxylic acids or metal 1,3-dione chelates.

In accordance with a particular aspect of the invention, hypergolicity-imparting catalysts are provided. These catalysts are formed by the reaction (chemical union) of the metal salt of an aliphatic carboxylic acid or a metal acetoacetonate with various alkyl-substituted diamines or triamines, wherein the amine is an integral constituent of the catalyst compound at the molecular level. The catalyst complexes can be synthesized and isolated prior to use or prepared in situ in the fuel mixture. The catalyst complexes formed in accordance with the present invention may be soluble in non-polar as well as polar organic fuels.

In accordance with another aspect of the invention, acetylenic compounds or a stoichiometric excess of alkyl-substituted diamines or triamines are used as co-solvents or phase-joiners to impart solubility to the catalysts in non-polar hydrocarbon fuels.

Another aspect of the invention involves the use of terminal or internal acetylenic compounds as additives to render solutions of the catalyst complexes resistant to or impervious to the effects of auto-oxidation, thereby limiting the formation of insoluble precipitates, coagulates, or turbidity.

In accordance with another manifestation of the invention, conjugated acetylenes may be used instead of a stoichiometric excess of the amines as promoters in conjunction with the described catalysts to impart hypergolicity to various organic fuels.

In accordance with more particular aspects of the present invention, the catalyst-fuel mixtures can be prepared under conditions which exclude oxygen (i.e. anaerobic conditions) by removing any dissolved oxygen from reagents, solvents, and fuel components by boiling or sparging with inert gas (i.e. nitrogen or argon). Anaerobic preparation of the catalyst-fuel mixtures can improve stability.

The present invention also relates to complexes of metallic species and alkyl-substituted diamines or triamines useful as catalysts wherein the amine is an integral constituent of the catalyst compound.

DETAILED DESCRIPTION OF THE INVENTION

The present invention relates to the use of the complexes formed by metallic salts of aliphatic carboxylic acids or metallic chelate 1,3-dione compounds with alkyl-substituted diamines or alkyl-substituted triamines, as catalysts to impart hypergolicity (i.e. self-ignition) to a wide variety of both polar (i.e. alcohols) and non-polar (i.e. octane, decane, kerosene) organic fuels when rocket-grade hydrogen peroxide is employed as an oxidizer. "Rocket-grade" hydrogen peroxide is an article of commerce that is generally defined as comprising 85–100% by weight hydrogen peroxide containing less than 0.1 mg/liter of sodium, phosphorous, or tin ions.

The alkyl substituted diamines and alkyl-substituted triamines are integral constituents of the catalyst at the molecular level. If the amines are employed in stoichiometric excess, however, they can additionally serve as either promoters or co-solvents (phase-joiners). In accordance with the present invention, the catalyst complexes impart hypergolicity to various liquid organic fuels when utilizing hydrogen peroxide as an oxidizer.

Various amines can also be used as promoters, co-solvents or phase-joiners. The term "promoter" as used herein refers to a substance added in small amounts to a catalyst to improve the activity, selectivity or longevity of the catalyst. The liquid organic fuels may be polar or non-polar.

In accordance with the present invention, the organometallic compounds reacted with an amine to form the catalyst complex utilized to impart hypergolicity to the liquid organic fuels are metal salts of aliphatic carboxylic acids or metal chelates of 1,3-dione compounds. Examples of the metallic species useful in the present invention include, but are not limited to, manganese, cobalt, copper, silver, or mixed compounds thereof. The aliphatic carboxylate moieties include compounds having up to 15 carbon atoms and, more particularly up to 10 carbon atoms and still more particularly up to 6 carbon atoms such as acetates, propionates, and butyrates.

The term "1,3-dione" as used herein refers to a class of diones in which a single carbon atom is interposed between a pair of carbonyl carbon atoms. These diones may have up to 15 carbon atoms and more particularly up to 10 carbon atoms and still more particularly up to 6 carbon atoms. The term includes compounds such as 2,4-pentanediones and 3,5-heptanediones that have this characteristic structure.

The metallic species is usually employed in an amount up to about 8% by weight based on the total weight of the organic fuel component of the propellant. Amounts higher than 8% can be used but they are generally unnecessary. The minimum amount sufficient to render the fuel hypergolic can be determined empirically based on ignition studies. Amounts as low as 1% can be useful.

The amines useful in the present invention may be alkyl-substituted amines such as diamines of the form:

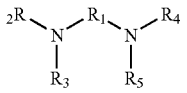

where $R_1$ is methylene, ethylene, propylene, butylene, hexylene, etc. $R_2$, $R_3$, $R_4$, $R_5$ can be H, methyl, ethyl, propyl, butyl, pentyl, hexyl, etc. Specific examples of diamines useful in the present invention include, but are not limited to, 1,3-pentanediamine (DuPont "DYTEK"); N,N-dimethylethylenediamine ("DMEDA"); N,N,N',N'-tetramethylethylenediamine ("TMEDA") and N,N,N',N'-tetramethyl-1,3-butanediamine ("TMBDA").

Also useful in the present invention are alkyl-substituted triamines, such as those of the form:

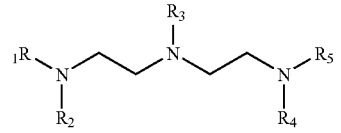

where $R_1$, $R_2$, $R_3$, $R_4$, $R_5$ can be H, methyl, ethyl, propyl, butyl, pentyl, hexyl, etc. A specific example of a useful triamine is N,N,N',N',N"-pentamethyldiethylenetriamme.

The amines can play one or a combination of up to three roles, namely, they can function as promoters or co-solvents as well as be integral constituents of the catalyst, depending on the amount in which they are employed. The amine can be used in amounts that range from about 1 to 20% in some embodiments of the invention. At concentrations in excess of a stoichiometric concentration based on the metallic species, they can function as a promoter. In higher concentrations such as in excess of a few percent they also function as a co-solvent for the catalyst.

The metal salts of aliphatic carboxylic acids and the amines used in the present invention combine to form distinct chemical compounds or complexes with characteristic stoichiometric ratios of metal salt to amine. In these instances, the amine is an integral constituent of the catalyst compound at a molecular level and does not serve as a promoter. Complexes exhibiting improved stability can be formed by preparing the complexes under anaerobic conditions wherein any dissolved oxygen is removed from reagents, solvents and fuel components. These compounds can be very active catalysts in their own right, and in certain instances do not require the use of excess (free) amines such as TMBDA to render the fuel hypergolic. In certain cases, these catalysts may make it possible to formulate hypergolic organic fuels without adversely lowering the flash point of the fuel.

The invention includes embodiments in which the amine and the metallic species are pre-reacted and added to the fuel as well as embodiments in which they are reacted in situ in the fuel to form the complex.

It has been discovered that the addition of acetylenic compounds (excellent fuels in their own right) to solutions of the metal-amine complexes renders the complexes in certain embodiments resistant to or even impervious to autooxidation. These acetylenic compounds can have up to 20 carbon atoms and more particularly up to 15 carbon atoms. Representative examples of acetylenic compounds include, but are not limited to, terminal acetylenes such as 1-octyne and ethynylcyclopropane ("ECP" or cyclopropylacetylene), and conjugated internal acetylenes such as 1,4-dicyclopropylbuta-1,3-diyne (the dimer of ethynlcyclopropane or "ECP dimer"). Although not wishing to be bound, it is believed that the mechanism of this protective action may be formation of a molecular cage arising from a coordination compound that forms in solution. Similar complexes of disubstituted acetylenes with metal carbonyls have previously been reported in the literature (Nicholas et al., Tetrahedron Letters, 3475 (1971)), notably with dicobalt octacarbonyl:

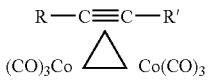

where R and R' are identical or different and can be H, alkyl or carboxyl. Because the acetylenic compound can also function as a fuel, the upper limit on the amount in which it is used is open. The minimum effective amount can be readily determined empirically. It is typically used in an amount that is about equal to the complex to several times the amount of the complex. For example, about 1 to 20 times the amount of the complex can be used.

It has also been discovered that certain conjugated acetylenes, like 1,4-dicyclopropylbuta-1,3-diyne, are capable of serving as promoters, enhancing the catalytic activity as well as the stability of the metal-amine complexes of the present invention.

The bipropellant is a two part fuel made up of the organic fuel component containing the additives described herein and an oxidizer component that is typically "rocket grade" hydrogen peroxide (i.e., +85% $H_2O_2$). The organic fuel component may contain about 50 to about 97% of the organic fuel.

The invention is illustrated in more detail by the following non-limiting examples. The following hypergolicity tests were performed by allowing one drop of 95% hydrogen peroxide to fall onto two drops of a catalyst-containing solution placed in the hemispherical well of a porcelain spot plate.

EXAMPLE 1

Manganese (II) Acetate Tetrahydrate and TMEDA 2.45 grams of manganese (II) acetate tetrahydrate ("MAT") dissolves in 24.5 grams of N,N,N',N'-Tetramethylethylenediamine ("TMEDA") at 20° C. to form a non-turbid, pale yellow or straw colored solution (9.1% MAT by weight). Chilling of this solution to 0° C. overnight did not result in any precipitate falling out of solution.

If the excess TMEDA is removed by gentle heating in vacuo, an off-white or pale ivory crystalline solid remains, easily distinguished from the characteristic pale pink hue of manganese (II) acetate tetrahydrate. Analysis of this complex revealed that it contains no water of hydration and consists of one molecule of manganese (II) acetate bound to one molecule of TMEDA. It decomposes upon heating to 120° C., with the accompanying loss of TMEDA. The compound is very sparingly soluble in aliphatic hydrocarbons (<1% by wt. in kerosene), but freely soluble in alcohols and acetylenic hydrocarbons.

Solutions of the TMEDA complex of MAT in alcohols (e.g., methanol, ethanol, isopropanol) are not stable to oxidation when exposed to the atmosphere. Colloidal manganese dioxide and coagulation and precipitation of $Mn^+$ solids appear upon standing if exposed to air. However, it is notable that these solutions are stable if they are prepared under anaerobic conditions by removing any dissolved oxygen from reagents, solvents, and fuel components by foiling or by prolonged sparging of inert gas (i.e. nitrogen or argon.)

The 9.1% by wt. solution of MAT in TMEDA is freely miscible with the dimer of ethynlcyclopropane ("ECP dimer"), forming a transparent, non-turbid pale yellow liquid. A dimer is stable and does not exhibit turbidity or precipitation upon exposure to air or chilling to 0° C.

A mixture consisting of 33% by wt. MAT and TMEDA, 67% by wt. ECP dimer (3% contained MAT by wt.) is vigorously hypergolic. When a drop of 95% hydrogen peroxide falls on two drops of this fuel placed in the well of a porcelain spot plate, there is an immediate loud report that sounds like the discharge of a cap pistol, followed by flame.

A perceptible reduction in the vigor of the reaction with hydrogen peroxide was observed with a mixture of 0.5 grams of the 9.1% by wt. solution of MAT in TMEDA and 1.5 grams of ECP dimer (2.3% contained MAT by wt.), but even this mixture proved quite hypergolic.

Mixtures consisting of 33% by wt. MAT and TMEDA with: 67% by weight iso-octane; 67% by wt. decane; and 67% by wt. kerosene (3% contained MAT by wt. in every case), all proved to be vigorously hypergolic.

Manganese acetate-TMEDA solutions in ECP dimer appear to be impervious to auto-oxidation and resist growing turbid or throwing down precipitates upon exposure to air.

EXAMPLE 2

Crystalline Manganese Acetate-TMEDA Complex 0.1 grams of the crystalline manganese acetate-TMEDA complex (containing no free TMEDA) was dissolved in a mixture of 2.50 grams of 1,4-dicyclopropylbuta-1,3-diyne (the dimer of ethynlcyclopropane or "ECP dimer"). No free TMEDA was added. The resulting solution was intensely hypergolic.

0.1 grams of the crystalline manganese acetate-TMEDA complex (containing no free TMEDA) was dissolved in a mixture of 0.75 grams of 1,4-dicyclopropylbuta-1,3-diyne (the dimer of ethynlcyclopropane or "ECP dimer") and 0.75 grams of kerosene. No free TMEDA was added. The resulting solution was extremely hypergolic.

EXAMPLE 3

Cobalt (II) Acetate Tetrahydrate and TMEDA 0.2 grams of cobalt (II) acetate tetrahydrate was dissolved in 3.0 grams TMEDA, forming a transparent magenta solution. If the excess TMEDA is removed by gentle heating in vacuo, a magenta crystalline solid remains, easily distinguished from the characteristic intense magenta hue of cobalt (II) acetate tetrahydrate. Analysis of this complex reveals that it contains no water of hydration and consists of one molecule of cobalt (II) acetate bound to one molecule of TMEDA. This compound melts at 154° C. without the accompanying loss of TMEDA. It is very sparingly soluble in aliphatic hydrocarbons and kerosene (<1% by wt.), but freely soluble in alcohols and acetylenic hydrocarbons that are ideal rocket propellants.

A solution of cobalt (II) acetate in TMEDA is appreciably more stable to autoxidation than its manganese analog. However, upon exposure to air (or sparging of air using a fritted air stone), solutions of the cobalt (II) acetate-TMEDA complex in methanol or kerosene grow turbid and throw down solids (off white or pale pink, rather than the brown of $MN^{+4}$).

0.5 grams of the above cobalt (II) acetate tetrahydrate and TMEDA solution added to 1.0 grams of ECP dimer forms a stable, transparent solution that is extremely hypergolic.

EXAMPLE 4

Copper (II) Acetate Hydrate and TMEDA

A saturated solution of copper (II) acetate hydrate in methanol (5% by wt.) is not hypergolic. Nor is a 5% by weight solution of TMEDA in methanol hypergolic. However, if 0.3 grams of a saturated solution of copper (II) acetate hydrate in TMEDA is added to 0.6 grams of methanol, the resulting solution is intensely hypergolic.

If the excess TMEDA is removed by gentle heating in vacuo, a vivid blue crystalline solid remains, easily distinguished from the characteristic green hue of copper (II) acetate hydrate. Analysis of this complex reveals that it contains no water of hydration and consists of one molecule of copper (II) acetate bound to one molecule of TMEDA. This compound melts at 175° C. without the accompanying loss of TMEDA. It is very sparingly soluble in aliphatic hydrocarbons and kerosene (<0.5% by wt.), but freely soluble in alcohols and acetylenic hydrocarbons that are ideal rocket propellants.

0.3 grams of a saturated solution of copper (II) acetate hydrate in TMEDA added to 0.6 grams of ECP dimer is weakly hypergolic, producing a flame after a very perceptible delay of approximately half a second.

EXAMPLE 5

Copper (II) Butyrate and TMEDA

A saturated solution of copper (II) butyrate in methanol (about 4% by wt.) is not hypergolic. However, if 0.5 grams of a saturated solution of copper (II) butyrate in TMEDA is added to 1.0 grams of methanol, the resulting solution is very hypergolic.

If the excess TMEDA is removed by gentle heating in vacuo, turquoise-blue crystalline solid remains, easily distinguished from the characteristic more pallid blue color of copper (II) butyrate. Analysis of this material reveals that it consists of one molecule of copper (II) butyrate bound to one molecule of TMEDA. This compound is very sparingly soluble in aliphatic hydrocarbons and kerosene (approximately 1% by wt.), but freely soluble in alcohols and acetylenic hydrocarbons that are ideal rocket propellants.

Solutions of the copper (II) butyrate-TMEDA complex in methanol are stable to autooxidation and do not throw down precipitates.

EXAMPLE 6

Copper (II) Acetylacetonate and TMEDA

A saturated solution of copper (II) acetylacetonate is sparingly soluble (about 4% by wt.) in methanol. This solution is not hypergolic. If one part of a saturated solution of copper (II) acetylacetonate in TMEDA (<2% by wt. at 20° C.) is added to two parts by weight methanol, the resulting solution is intensely hypergolic.

EXAMPLE 7

Silver Acetate and TMEDA

Unlike the acetates of manganese, cobalt, and copper, silver acetate is virtually insoluble in methanol, ethanol, and other alcohols. If silver acetate is shaken with methanol in a test tube, centrifuged, and an aliquot of the supernatant liquid withdrawn, this will be found to contain so little dissolved silver acetate that it produces only very mild effervescence with 98% hydrogen peroxide.

However, the addition of modest quantities of organic amines renders the silver acetate readily soluble in methanol. By placing a precisely weighed amount of silver acetate in an excess of methanol and slowly dispensing amines with vigorous agitation, it has been determined that a 2:1 molar ratio of TMEDA to silver acetate is required to completely dissolve the silver acetate.

When manganese, cobalt, or copper acetate hydrates are heated with an excess of TMEDA in methanol and the excess TMEDA, methanol, and water are removed at 100 degrees C. in vacuo, crystalline complexes corresponding to a 1:1 molar ratio of metal acetate to TMEDA and no water of hydration can be isolated. However, no analogous complex of TMEDA with silver acetate can be prepared in this fashion. Apparently the affinity of silver acetate to TMEDA is sufficiently weak that the silver acetate-amine complex exists only in solution. This is not surprising when one considers that the atomic weight of silver is 107.9, while the atomic weights of manganese, cobalt, and copper are 54.9, 58.9, and 63.5 respectively.

A 1.8% by weight solution of silver acetate in methanol containing 2.8% by wt. TMEDA is hypergolic; increasing the silver acetate content above 2% by weight and the TMEDA content above 3.1% renders the solution intensely hypergolic.

Having described the invention in detail by reference to specific embodiments thereof, it will be apparent that numerous modifications and variations are possible without departing from the spirit and scope of the following claims.

What is claimed is:

1. A method of rendering an organic fuel hypergolic with hydrogen peroxide, comprising the steps of:

providing a polar or non-polar organic fuel selected from the group consisting of kerosene, methanol, ethanol, isopropanol, octane, iso-octane, decane and mixtures thereof; and contacting said organic fuel with a hypergolicity-imparting catalyst, thereby forming a catalyst-fuel mixture, wherein said hypergolicity-imparting catalyst comprises a complex of an alkyl-substituted diamine or alkyl-substituted triamine with a metal salt of an aliphatic carboxylic acid, wherein said metals are selected from the group consisting of manganese, cobalt, copper, silver, and combinations thereof and said metal salts of aliphatic carboxylic acids are selected from the group consisting of acetates, propionates, butyrates, and combinations thereof, wherein the catalyst-fuel mixture is hypergolic with rocket grade hydrogen peroxide.

2. The method of claim 1 wherein said metal salt and said diamine or said triamine react in situ to form the hypergolicity-imparting catalyst.

3. The method of claim 1 wherein said hypergolicity-imparting catalyst is synthesized and isolated prior to contacting with said organic fuel.

4. The method of claim 1 wherein said amine comprises an alkyl substituted diamine.

5. The method of claim 4 wherein said alkyl substituted diamine is selected from the group consisting of 1,3-pentanediamine; N,N-dimethylethylenediamine; N,N,N',N'-tetramethylenediamine and N,N,N',N'-tetramethyl-1,3-butanediamine.

6. The method of claim 1 wherein said alkyl substituted triamine comprises N,N,N',N',N'-pentamethyldiethylenetriamine.

7. The method of claim 1 wherein said hypergolicity-imparting composition further comprises a co-solvent or phase-joiner to impart solubility to said catalyst in non-polar organic fuels, said co-solvent or phase-joiner being selected from acetylenic compounds or a stoichiometric excess of said amine.

8. The method of claim 7 wherein said co-solvent or phase-joiner comprises a stoichiometric excess of N,N,N',N'-tetramethylethylenediamine.

9. The method of claim 7 wherein said hypergolicity-imparting composition further comprises a terminal or internal acetylenic compound wherein said acetylenic compound renders said hypergolicity-imparting catalyst resistant to or impervious to the effects of auto-oxidation, thereby limiting the formation of insoluble precipitates, coagulates, or turbidity.

10. The method of claim 7 wherein said hypergolicity-imparting composition further comprises a conjugated acetylene.

11. The method of claim 10 wherein said conjugated acetylene comprises 1,4-dicyclopropylbuta-1,3-diyne.

12. The method of claim 1 wherein said catalyst fuel mixture is prepared under anaerobic conditions.

13. A method of rendering an organic fuel hypergolic with hydrogen peroxide, comprising the steps of:

providing a polar or non-polar organic fuel selected from the group consisting of kerosene, methanol, ethanol, isopropanol, octane, iso-octane, decane and mixtures thereof; and contacting said organic fuel with a hypergolicity-imparting catalyst, thereby forming a catalyst-fuel mixture, wherein said hypergolicity-imparting catalyst comprises a complex of an amine selected from the group consisting of alkyl-substituted diamines and alkyl-substituted triamines with a metal salt of an aliphatic carboxylic acid, wherein said metals are selected from the group consisting of manganese, cobalt, copper, silver, and combinations thereof and said metal salts of aliphatic carboxylic acids are selected from the group consisting of acetates, propionates, butyrates, and combinations thereof, the catalyst-fuel mixture comprising:

from about 50 to 97 weight % organic fuel;

from about 1 to 8 weight % metal salt of an aliphatic acid; and from about 1 to 20 weight % amine, wherein the catalyst-fuel mixture is hypergolic with rocket grade hydrogen peroxide.

14. The method of claim 13 wherein said hypergolicity-imparting composition further comprises a terminal or internal acetylenic compound having from 1 to 20 carbon atoms wherein said acetylenic compound renders said hypergolicity-imparting catalyst resistant to or impervious to the effects of auto-oxidation, thereby limiting the formation of insoluble precipitates, coagulates, or turbidity.

* * * * *

UNITED STATES PATENT AND TRADEMARK OFFICE

CERTIFICATE OF CORRECTION

PATENT NO. : 7,083,690 B2
APPLICATION NO. : 10/180210
DATED : August 1, 2006
INVENTOR(S) : Thomas A. Dobbins et al.

It is certified that error appears in the above-identified patent and that said Letters Patent is hereby corrected as shown below:

On the title page: Item (57) Abstract

Line 5 - Change "1,3" to --1,3- --.

Signed and Sealed this

First Day of May, 2007

JON W. DUDAS
*Director of the United States Patent and Trademark Office*